US006568014B1

(12) United States Patent
Sabalaskey et al.

(10) Patent No.: US 6,568,014 B1
(45) Date of Patent: May 27, 2003

(54) EDGE SUPPORT ON A MATTRESS

(75) Inventors: Robert J. Sabalaskey, Carol Stream, IL (US); Robert E. Malin, Itasca, IL (US); Alvin R. Klancnik, Spring Lake Drive, IL (US)

(73) Assignee: Serta, Inc., Itasca, IL (US)

( * ) Notice: Subject to any disclaimer, the term of this patent is extended or adjusted under 35 U.S.C. 154(b) by 0 days.

(21) Appl. No.: 10/109,983

(22) Filed: Mar. 28, 2002

(51) Int. Cl.[7] ..... A47C 23/04; A47C 27/07
(52) U.S. Cl. ..... 5/717
(58) Field of Search ..... 5/717, 739, 716, 5/719

(56) References Cited

U.S. PATENT DOCUMENTS 1,974,044 A * 9/1934 Foster ..... 5/717
2,152,237 A * 3/1939 Bechik ..... 5/717
3,262,135 A 7/1966 Fasanella
3,618,146 A 11/1971 Ferdinand
3,822,426 A * 7/1974 Mistarz ..... 5/717
3,848,283 A 11/1974 Ikeda
4,067,076 A 1/1978 Krier
5,787,532 A 8/1998 Langer et al.
6,158,071 A 12/2000 Wells
6,243,894 B1 6/2001 Kosumsuppamala et al.
6,263,533 B1 7/2001 Dimitry et al.

* cited by examiner

*Primary Examiner*—Alexander Grosz
(74) *Attorney, Agent, or Firm*—Gardner Carton & Douglas LLC

(57) ABSTRACT

An innerspring mattress having an edge support insert that overlaps the upper and lower border wires of the mattress. The edge support insert has a C-shaped cross-section or the cross-section may gradually thicken from interior corners of the "C" toward the center forming a putative E-shaped cross-section. The edge support may be a continuous unit that is installed around the entire perimeter of the innerspring mattress assembly. The simple cross-section allows efficient extrusion manufacturing and is efficiently installed around the innerspring mattress coil matrix.

5 Claims, 4 Drawing Sheets

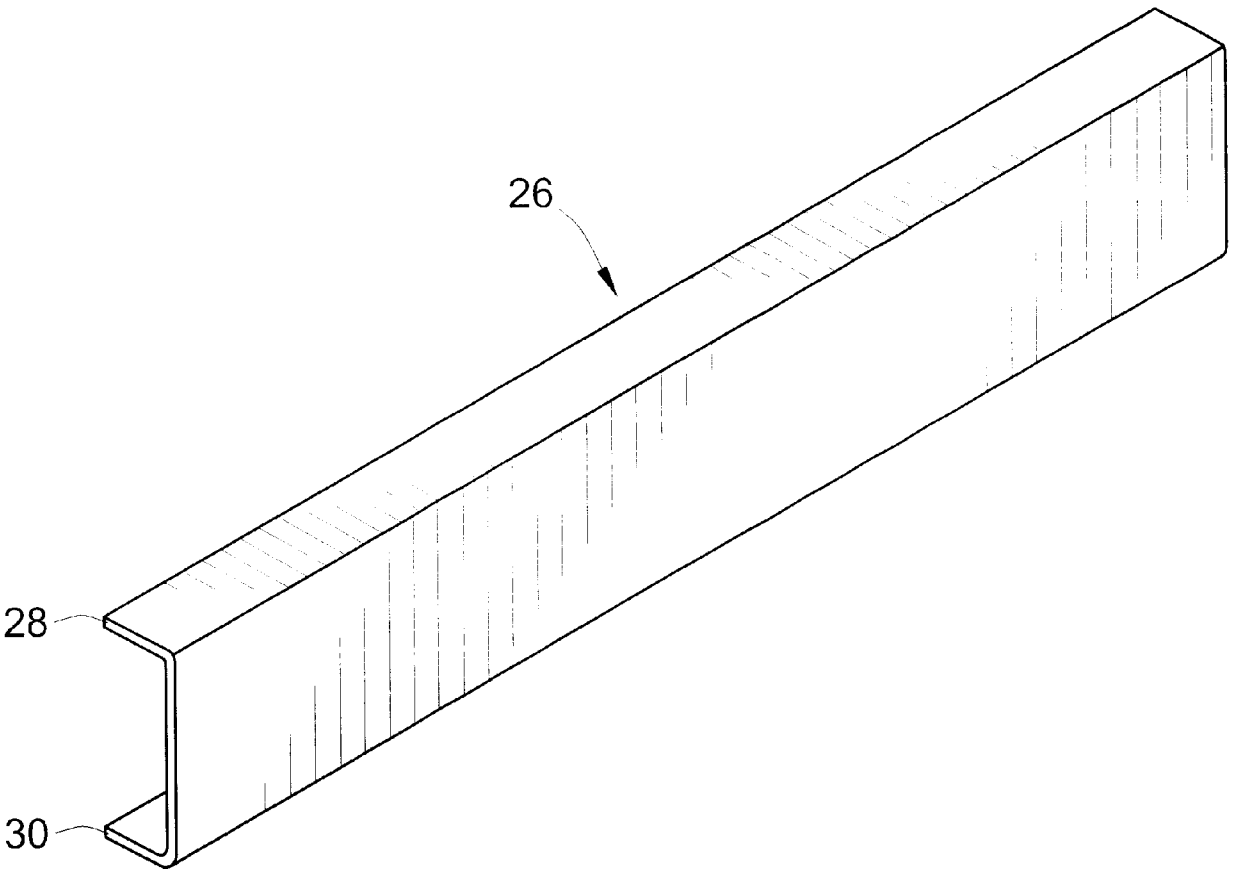
FIG. 2
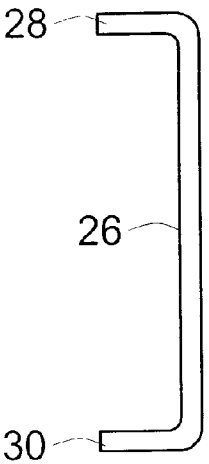

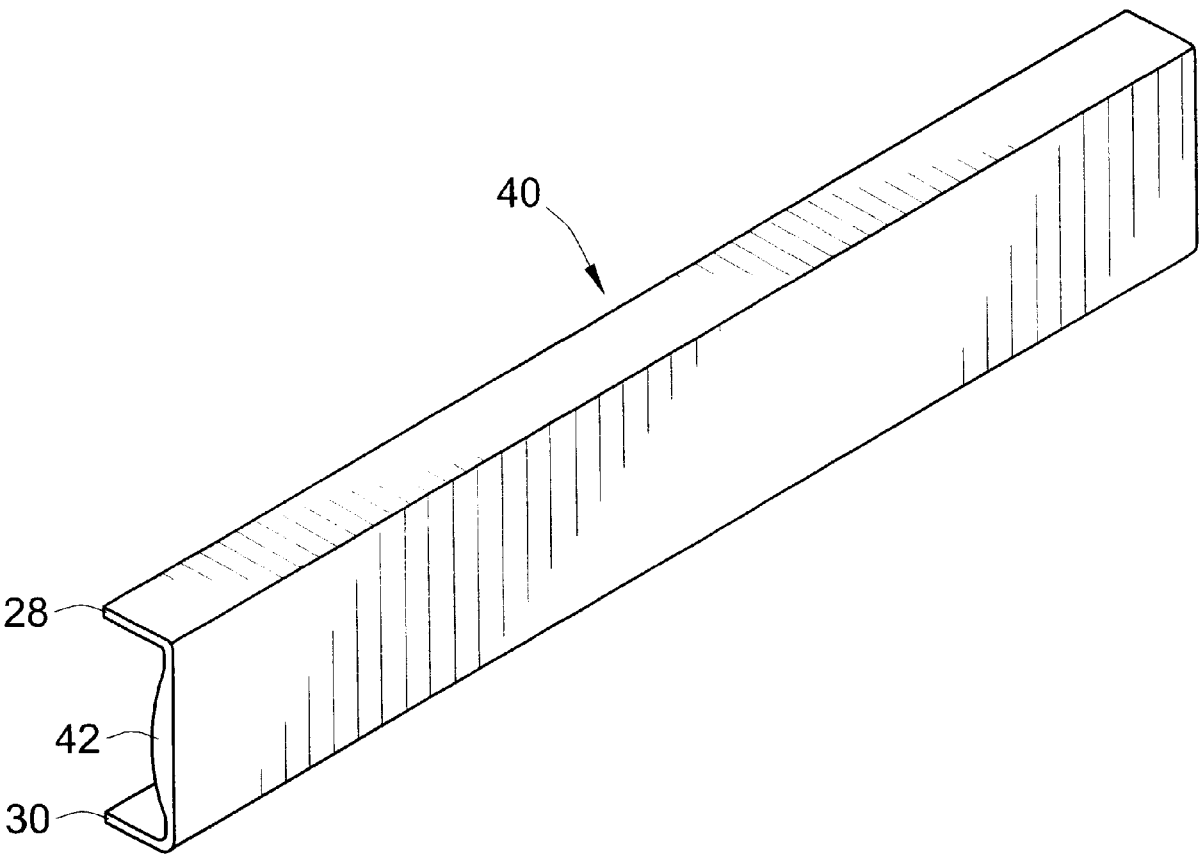
FIG. 2a
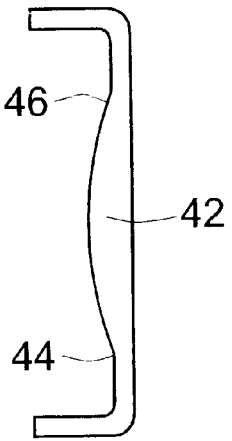

EDGE SUPPORT ON A MATTRESS

FIELD OF THE INVENTION

The invention relates to an edge support system for a mattress.

BACKGROUND OF THE INVENTION

Innerspring mattresses are typically assembled by aligning a matrix of coils and tying the coils together at each terminus with helical wires. The coils located at the border of the matrix and the helical wires are secured to border wires that frame the coil matrix in the plane of each coil terminus. Similar innerspring assemblies may be used in the construction of furniture other than mattresses such as upholstered chairs and sofas. The innerspring assembly of coils and wires is wrapped with layers of padding, bunting, ticking and upholstery materials to provide a comfortable surface upon which a person may sit, lie, or sleep. Mattresses are typically assembled manually therefore it is desired that the mattress components be simple and fit together quickly and easily.

The edges or perimeter of the mattress generally require greater structural support to maintain the shape of the mattress. The greater edge support is required due to the need of mattress users to get on and off of the mattress from the perimeter. In so entering and exiting the mattress, a person may sit or stand on the edge of the mattress for a period of time. A person may also use the edge of a mattress as a seat. The coils of the innerspring located on the perimeter of the matrix will be subjected to increased loads and loading cycles by the sitting or standing of a person on the edge of the mattress. A person's weight distributed among a few coils, as when the person is sitting, applies a more concentrated load on the affected coils than does a more even distribution on a coil array as when a person is lying on the mattress. The added loading and load cycles at the edges of the mattress accelerate the wear on the edges and results in a rounding off of the mattress edges. This rounding off is accentuated by the layers of padding and upholstery materials that converge at the edges of the mattress.

To provide extra support at the perimeter of a mattress the prior art mattresses have incorporated a wood border member or padding or foam inserts that interlockingly engage with the coils of the mattress innerspring. The wood border members result in a mattress that is heavy and therefore more difficult to move. Other edge supports consisting of padding or foam strip inserts have been inserted between every convolution of the coils or between and around individual helical coils. The foam strips or pieces generally include a planar wall on one side and the opposing wall is shaped to fit between adjacent coils or between the convolutions of the coils and are usually constrained between the upper and lower border wires. The inserts have required the use of special corner reinforcement pieces that fit around the coil located in the corner of an approximately rectangular array of coils in the innerspring.

The innerspring edge and corner support components are extruded and are often of complex cross-sectional area. The complex cross-sectional area requires additional extruder maintenance during manufacture thereby increasing costs and manufacturing time. Additional extruded foam pieces of the mattress assembly also complicate the tailoring of the mattress by adding layers of material that must be sown around or incorporated into the stitches of the tailoring. The number of individual edge and corner support components required to add support around the entire mattress generally increase assembly time and costs.

Therefore, there exists a need for a mattress edge support system that may be continuously extruded and used for completely encompassing a mattress edge for added edge support. The mattress edge support system may be installed on the coil matrix of a mattress as one continuous strip or may be sectioned into smaller lengths where one or more smaller lenghts are installed on the coil matrix. There is further a need for a mattress edge support system that allows decreased assembly time and streamlines tailoring of the mattress.

SUMMARY OF THE INVENTION

The present invention provides a continuously extruded edge support insert for a mattress. The edge support has a C-shaped cross-section or the cross-section may gradually thicken from interior corners of the "C" toward the center forming a putative E-shaped cross-section. When installed on the mattress, the thickening of the cross-section may coincide with the convolutions of the innerspring, but does not require interlacing between the convolutions. The edge support is installed on the innerspring assembly so that it encompasses both of the border wires. The edge support component is economical to manufacture because it is a single extruded unit of simple cross-section and therefore will not demand excessive extruder maintenance. Mattress assembly is streamlined by the use of the single edge support unit because the edge is easily and quickly wrapped around the border wires of the entire innerspring assembly and eliminates the requirement of specially designed corner pieces for edge support. Alternatively, the edge support system may be cut into small lengths or sections after extrusion, or extruded in smaller lengths, and installed by sections during assembly of the mattress. Further, mattress tailoring is streamlined by the elimination of the additional foam or materials that would otherwise be present with the use of separate corner support pieces.

BRIEF DESCRIPTION OF THE DRAWINGS

FIG. 2 depicts the edge support insert of the present invention.

FIG. 2*a* depicts the edge support insert of the present invention with the thickened cross-section.

DETAILED DESCRIPTION OF THE INVENTION

Figure 3:
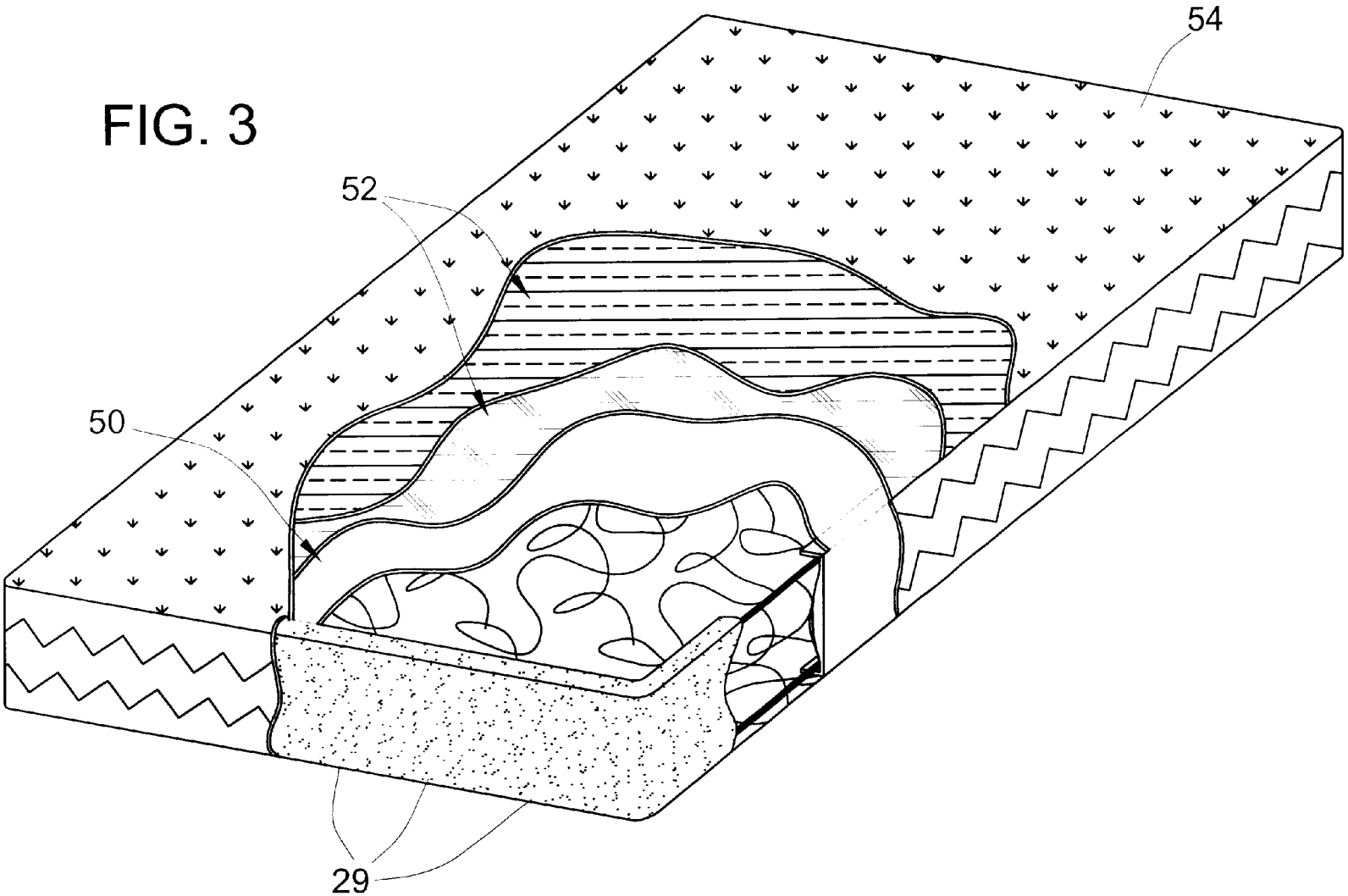
FIG. 3 depicts the mattress of the present invention having an edge support insert with a thickened cross-section fitted at the perimeter and the fabric layers tailored around the innerspring matrix.

An embodiment of the present invention provides an assembled mattress 10. The mattress is assembled by arranging the coils 20 in a substantially rectangular array and tying the coils 20 together with a helical wire 32. The helical wire 32 and coils 20 are secured to upper 22 and lower 24 border wires with metal clips or wire (not shown). The edge support insert 26 has a C-shaped cross-section with an upper leg 28 and a lower leg 30. During mattress assembly, the edge support insert 26 is installed around the perimeter of the innerspring matrix by overlapping the upper leg 28 of the edge support insert 26 with the upper border wire 22, and overlapping the lower leg 30 of the edge support insert 26 with the lower border wire 24. The edge support insert 26, as installed, fully encompasses the upper and lower border wires 22, 24 as shown in FIG. 1*a* and is held in place about the perimeter of the innerspring by fasteners 29 such as hog rings that connect the edge support 26 to the border wires 22, 24, as shown in FIG. 3. The configuration of border wires 22, 24 and edge support insert 26 also provides protection to the border wires 22, 24 during shipment or use.

Figure 1:
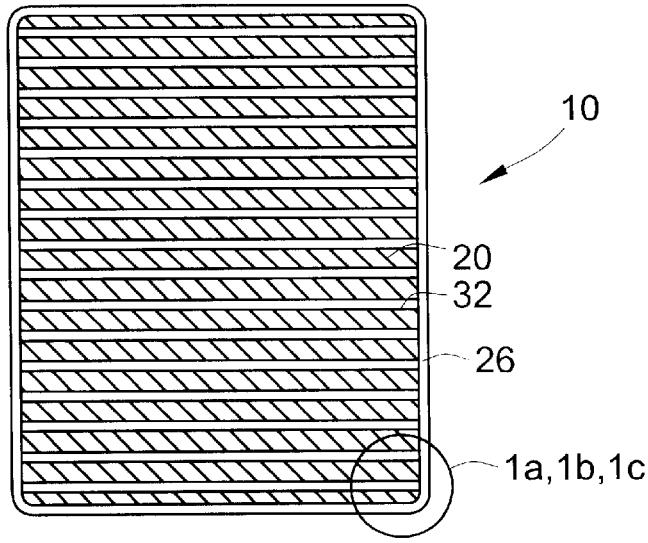
FIG. 1 is a plan view of the mattress of the present invention depicting the innerspring matrix of coils
Figure 1B:
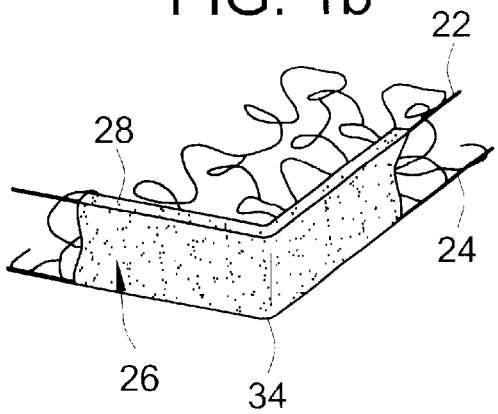
FIG. 1*b* is an enlarged view of a section of the mattress of FIG. 1 depicting the edge support insert fitted around a corner of the innerspring matrix.
Figure 1A:
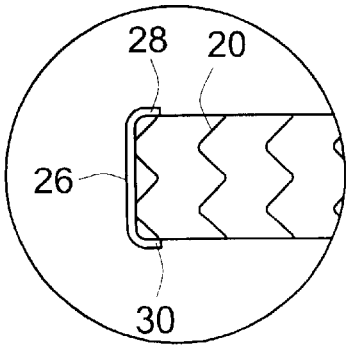
FIG. 1*a* is a cross-sectional view of the mattress of FIG. 1 depicting the edge support insert around the border wires.
Figure 1C:
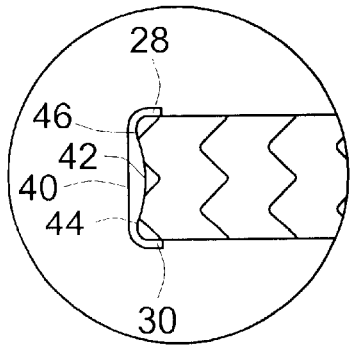
FIG. 1*c* is a cross-sectional view of the mattress of FIG. 1 depicting the edge support insert with a thickened cross-section around the border wires.

The edge support 40 of FIG. 1*c* depicts a thickening 42 in the interior region of the C-section. The thickening 42 is a gradual sloping of the surfaces of the cross-section that converge in the center of the edge support 40. The origins 44, 46 of the thickening 42 may coincide with the convolutions of the innerspring coils 20 as shown in FIG. 1*c*, but such coincidence is not required to effect the benefits of the edge support 40. The cross-section of the edge support, therefore, has a putative E-shape.

The edge support insert 26 or 40 may be bent around the corners of the matrix of coils 20 as shown in FIG. 1*b*, or may be manufactured to contain a corner bend region 34 at specified locations along the length of the edge support insert 26, 40. The edge support insert 26, 40 is made of a flexible polymer and may be polyethylene packing foam. The edge support insert 26, 40 may be manufactured in large lengths and rolled for shipping or may be sectioned into shorter lengths where more than one length of the edge support insert 26, 40 is installed around the matrix of innerspring coils 20. The rolling of large lengths of edge support insert 26, 40 materials further contribute to the efficiency of manufacture because extruder operations are most efficiently coupled with materials that may be rolled. Rolls of material are also more efficiently handled at the assembly site than are individual pieces. The rolls of edge support insert 26, 40 material may then be cut to size at the location of mattress 10 assembly. The width of the edge support insert 26, 40 between the upper leg 28 and the lower leg 30 may vary depending upon the overall size of mattress 10 innerspring coils 20.

The assembly of coils 20, wires 32, border wires 22, 24 and edge support insert 26, 40 is wrapped with layers of insulation 50, upholstery materials 52, and quilting 54 as shown in FIG. 3. The simplicity in design of the edge support insert 26, 40 allows improved tailoring of the upholstery materials 52 and quilting 54 by providing relatively smooth edges and corners that eliminate a bunching of material that makes tailoring difficult.

It should be understood that various changes and modifications preferred in the embodiment described herein will be apparent to those skilled in the art. Such changes and modifications can be made without departing from the spirit and scope of the present invention and without demising the attendant advantages. It is, therefore, intended that such changes and modifications be covered by the appended claims.

What is claimed is:

1. A mattress, comprising:

an innerspring matrix comprising a plurality of interconnected innerspring coils wired together and secured to an upper and a lower border wire;

an edge support insert comprising a c-shaped continuously extruded polymeric foam material having an upper leg and a lower leg, the upper leg overlapping the upper border wire and the lower leg overlapping the lower border wire; and a plurality of fabric layers tailored about the entire innerspring matrix.

2. The mattress of claim 1, wherein the edge support encloses the matrix and bends to conform to a corner of the mattress innerspring matrix.

3. The mattress of claim 1 wherein the continuously extruded polymer is polyethylene packing foam.

4. A mattress, comprising:

an innerspring matrix comprising a plurality of interconnected innerspring coils wired together and secured to an upper and a lower border wire;

an edge support insert comprising a c-shaped foam material having an upper leg and a lower leg, the upper leg overlapping the upper border wire and the lower leg overlapping the lower border wire, wherein the edge support insert comprises a section of bent material to conform to a corner of the mattress and a section of straight material to conform along a side of the mattress; and a plurality of fabric layers tailored about the entire innerspring matrix.

5. A mattress, comprising:

an innerspring matrix comprising a plurality of interconnected innerspring coils wired together and secured to an upper and a lower border wire;

an edge support insert comprising a c-shaped foam material having an upper leg and a lower leg, the upper leg overlapping the upper border wire and the lower leg overlapping the lower border wire, wherein the edge support insert of c-shaped foam material has a thickened interior forming a putative E-shaped cross-section; and a plurality of fabric layers tailored about the entire innerspring matrix.

* * * * *